United States Patent [19]

Finnegan

[11] Patent Number: 4,461,407

[45] Date of Patent: Jul. 24, 1984

[54] AUTOMATIC PRESSURE RELEASE MECHANISM FOR CAULK GUN

[76] Inventor: Danny Finnegan, 6840 Hickory Ave., Orangevale, Calif. 95662

[21] Appl. No.: 292,996

[22] Filed: Aug. 14, 1981

Related U.S. Application Data

[63] Continuation-in-part of Ser. No. 252,858, Apr. 10, 1981, abandoned.

[51] Int. Cl.[3] ..... B67D 5/42

[52] U.S. Cl. ..... 222/391; 222/327

[58] Field of Search ..... 222/325, 326, 327, 391, 222/386, 387, 388

[56] References Cited

U.S. PATENT DOCUMENTS

| | | | |
|---|---|---|---|
| 3,069,053 | 12/1962 | Nilsson | 222/391 |
| 3,140,078 | 7/1964 | Krahe et al. | 222/327 X |
| 4,033,484 | 7/1977 | Ornsteen | 222/391 |

*Primary Examiner*—Stanley H. Tollberg
*Attorney, Agent, or Firm*—Mark C. Jacobs

[57] ABSTRACT

A caulking gun of either the spring biased grip drive type or the ratchet driven type having an automatic pressure release structure which is actuated upon release of the gun trigger is disclosed. The pressure release structure relieves pressure on the portion that pushes the caulk from a tube thereof thereby causing a cessation of the flow of caulk.

5 Claims, 7 Drawing Figures

AUTOMATIC PRESSURE RELEASE MECHANISM FOR CAULK GUN

RELATED APPLICATIONS

This application is a continuation in part of my U.S. application Ser. No. 252,858 filed Apr. 10, 1981 abandoned whose text is incorporated herein by reference.

BACKGROUND OF THE INVENTION

1. Field of the Invention

The invention is in the field of caulking guns, and particularly in the field of release mechanisms for caulking guns utilizing either a ratchet-type drive mechanism or a spring biased grip engaging drive mechanism.

2. Description of the Prior Art

Caulking guns widely utilized by both professional homebuilders and the non-professional homeowner. Recently with the emphasis on insulation and energy saving efforts there has been an increasing demand for easy-to-operate caulking guns for use by non-professionals as an aid in reducing fuel bills by proper sealing of windows and doorways. Ratchet-type caulking guns are relatively inexpensive and easy to operate and have thus been widely utilized. The spring biased grip engaging drive type disclosed in U.S. Pat. No. 4,081,112 has also enjoyed an increase in sales. A common disadvantage in the utilization of any caulking gun is the inability to quickly release the pressure on the caulking tube to prevent spillover of the caulking material after a particular bead has been drawn. In some situations, the non-professional user of the caulking gun may even be unaware that the caulking material is needlessly being wasted by failure to timely shut off the flow of caulk by releasing the pressure on the driving piston. One mode of releasing the pressure on the grip engaging plunger mechanism gun is shown in Chang U.S. Pat. No. 4,081,112 issued Mar. 28, 1978. However this means is not automatic and requires the use of two hands, one to hold the gun and the second to actuate the release mechanism.

An improvement limited to the Chang type gun, which is automatic, is disclosed and claimed in Charles Finnegan's application Ser. No. 235,936 filed Feb. 19, 1981 abandoned.

An automatic shut-off for the ratchet type gun is disclosed and claimed in Hodgkins application Ser. No. 248,446 filed on Mar. 27, 1981 abandoned.

It is seen therefore that there is a need for an automatic pressure release mechanism which can be incorporated into either a ratchet-drive caulk gun or a biased grip engaging plunger mechanism gun. Such a gun requires no conscious effort to shut off the flow of caulk.

SUMMARY OF THE INVENTION

It is, therefore, an object of the invention to provide an automatic pressure release mechanism which is easy to utilize and inexpensive to fabricate and incorporate into a ratchet-type caulk drive mechanism, as well as into a biased grip engaging plunger caulk gun.

A further object of the invention is to provide an automatic release mechanism which needs no special actuation by the user thereof and is therefore effective for saving caulking material and preventing spillover even when utilized by an amateur.

In accordance with the invention, a caulking gun is provided having a housing for holding a caulking tube, a longitudinally moving rod and a piston member at one end thereof for driving caulking material out of the caulking tube, a handle secured to the housing, a trigger pivotally mounted to the handle and either a ratchet pawl for driving the rod and piston member or a spring biased grip that grips the rod for driving said rod and the piston member, and releasing means disposed on or at the rear of the housing for releasing the drive means from engagement with the rod.

In the ratchet drive unit, there is provided a first spring member for biasing the trigger away from the handle and a second spring member for biasing the ratchet pawl into engagement with ratchet teeth of the rod. The ratchet pawl is pivotally mounted to the handle for releasable engagement with the teeth of the rod for driving the rod and the piston member. A releasing means for releasing pressure upon the rod is disposed within the housing, which acts to release pressure by slightly withdrawing the rod when the trigger is positioned at or near its most remote or extended position from the handle. In this fashion, after the driving pawl urges the rod forwardly enabling caulking material to flow from the caulking tube, the release means retracts the rod thereby relieving pressure on the caulking tube at the very end of the trigger stroke to thereby prevent spillover of caulking material.

In the spring biased grip engaging mechanism a drive grip is urged into operational contact by the movement of the trigger. Said grip clamps the plunger under thrust of the trigger against a portion of the grip, moves forwardly and carries the rod forwardly with it at the same time. As will be discussed a coil spring biases the grip to a disengaging position and cooperates therewith to return the handle to a decompressed position.

The releasing means for this second version acts in a similar manner to slightly withdraw the rod thereby relieving pressure thereupon and causing a cessation in the flow of caulk.

An object is to provide novel means for relieving the pressure on the piston rod of a caulk gun.

Still another object is to provide novel automatic means for terminating the flow of caulk in a caulk gun.

Yet another object is to provide for the cessation of caulk flow in both the ratchet drive and in the spring biased grip driving caulk guns with the same means.

These and other objects of the invention will in part be obvious and will in part appear hereinafter.

The invention accordingly comprises the product possessing the features, properties and the relation of elements which are exemplified in the following detailed disclosure, and the scope of the application of which will be indicated in the claims.

For a fuller understanding of the nature and objects of the invention, reference should be had to the following detailed description taken in connection with the accompanying drawings, wherein like numbers refer to like parts.

DETAILED DESCRIPTION OF THE PREFERRED EMBODIMENT

Figure 1:
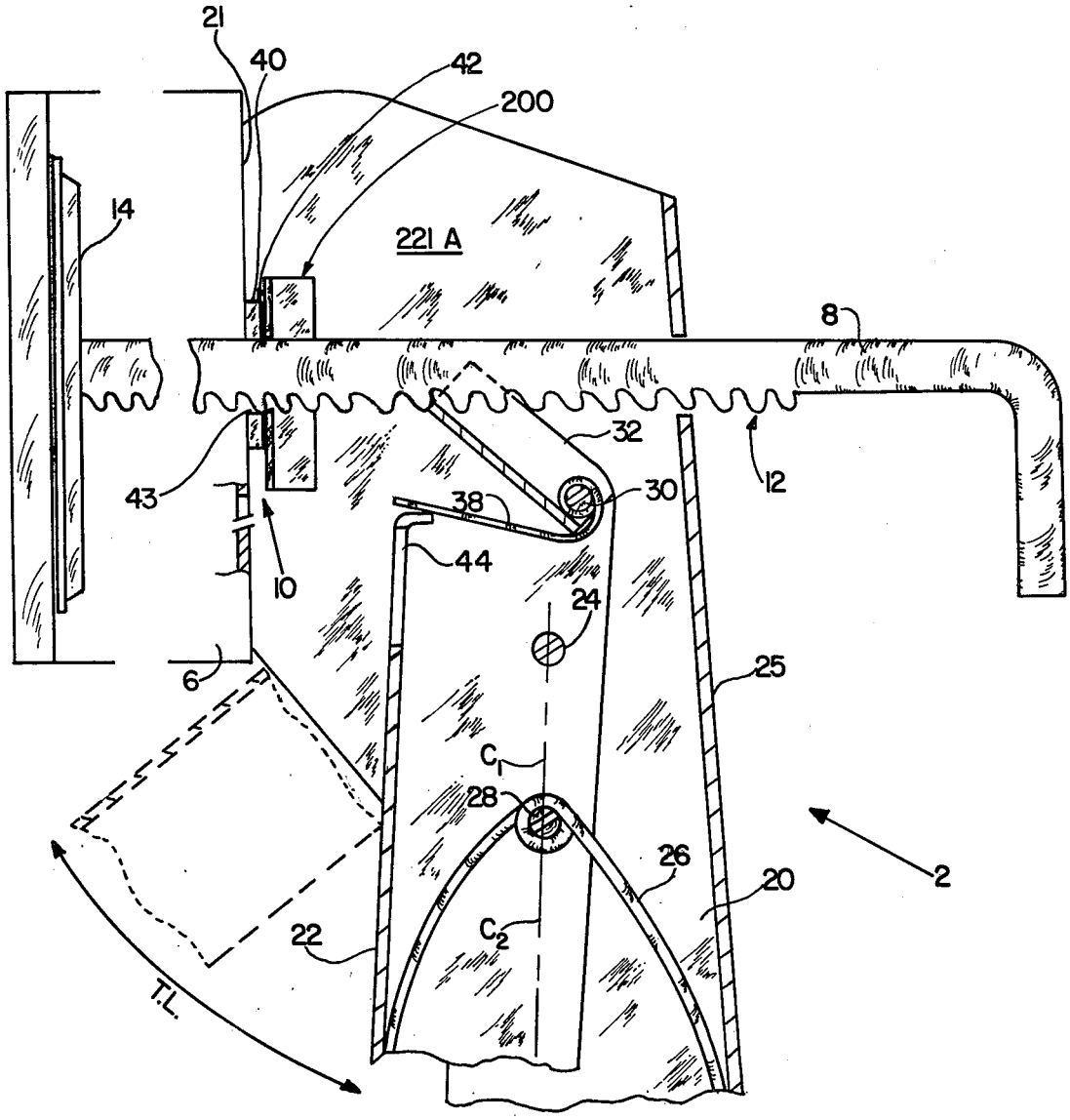
FIG. 1 is a side elevational view, partially sectioned, and illustrating a portion of ratchet drive caulking gun including the pressure release mechanism in accordance with the teachings of the invention during the pulling of the gun trigger.

FIG. 1 illustrates the detailed operation of a ratchet driven caulking gun 2 in accordance with one embodiment of the invention. The gun 2 is seen to hold a caulking cartridge nut shown which is secured within an open tublar barrel 6 forming part of the gun. A ratchet rod 8 having a bent portion or handle 10 is disposed along the longitudinal axis of the gun barrel 6 and is provided with ratchet teeth 12 on one side thereof. One end of the rod 8 is provided with a piston member 14 for engagement with the bottom portion of the cartridge tube to force caulking material out of the cartridge tube when the rod 8 is moved to the left as oriented in FIG. 1.

The gun 2 is also provided with a handle 20 and trigger 22 disposed for pivotal rotation about the pivot member 24. A spring 26 is provided about the support member 25 and makes contact with the handle 20 and trigger 22 to bias the trigger 22 away from handle 20. Optional finger grooves can be provided on the trigger 22 to facilitate gripping of the trigger for squeezing same for rotation about the pivot member 24 in a counterclockwise direction. The spring member 26 serves to bias the trigger 22 for rotation in a clockwise direction about the pivot member 24.

The driving mechanism for forcing the ratchet rod 8 against the bottom of the caulking tube 4 is achieved by utilizing a channel-shaped ratchet pawl 32 which is secured for pivotal movement about a pivot member 30. Spring 38 positioned around the pivot member 30 serves to bias the pawl 32 for movement in a clockwise direction thus ensuring contact of the pawl with teeth 12 of the ratchet rod 8. The mechanism described above is conventionally utilized to drive the ratchet rod 8 in order to bias the piston member 14 against the bottom of the cartridge tube 4. In operation, squeezing of the trigger 22 rotates the trigger in a counterclockwise direction thereby also rotating the ratchet pawl 32 in a counterclockwise direction thereby driving the ratchet rod 8 to the left as shown in FIG. 1. Upon releasing the trigger mechanism, trigger 22 is spring biased to rotate in a clockwise direction which forces the ratchet pawl 32 to disengage from the ratchet teeth 12 and to likewise rotate in a clockwise direction past several teeth 12 and rod 8. The rod, however, is maintained in its forward bias position by way of the action of the release means comprising release device 42 and retainer 200.

Figure 4:
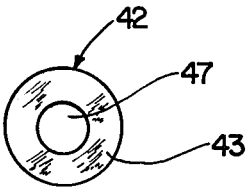
FIG. 4 is a front elevational view of a release device as shown in FIG. 1 and in FIG. 7.
Figure 5:
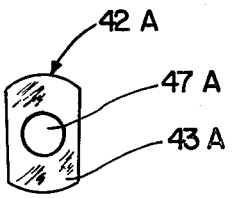
FIG. 5 is a front elevational view of another embodiment of the release device of FIG. 4.

Device 42 is a rubber resilient pusher having concentric solid and open sections 43 and 47, best seen in FIG. 4. Another version of the release device 42A is seen in FIG. 5. Here the device is generally rectangular with a central bore 47A near the top thereof. Rod 8 carries either of these versions, by passing through bore 47 or 47A respectively.

As seen in FIG. 1 handle 20 includes an aperture 40 through which passes rod 8.

Figure 2:
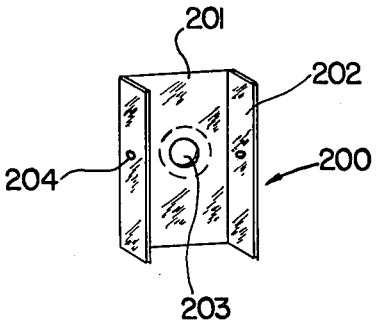
FIG. 2 is a closeup side perspective of a portion of one embodiment of the release means of this invention.

FIG. 2 is a perspective view of the retainer 200 employed to keep the release device disposed against intermediate wall 21 in order to achieve the desired result of flow cessation. Retainer 200 comprises a generally rectangular flat panel 207 having a pair of spaced equally apart rearwardly depending flanges 204 secured normal thereto. Retainer 200 is sized to fit within the space between the tin walls 221A and B of handle 20, per FIG. 3. Handle 8 passes through aperture 203 of the retainer during its travels.

Retainer 200 may be rivetted, arc welded or screwed to wall 221A and B. Apertures 204 are designed to receive small metal screen not shown.

In the ratchet type gun the automatic release means 10 comprises the retainer 200 which is spaced almost abutting the release device 40. The retainer is needed to prevent withdrawal of device 40 rearwardly upon withdrawal of rod 8.

Whereas in the spring biased caulk gun the pressure of the coil spring retains the release device at its operative location. See infra.

The retainer 200 may be fixedly secured to the housing 125's side walls 221, per FIG. 1 by welding, riveting, screwing or adhesiving it into place.

Figure 3:
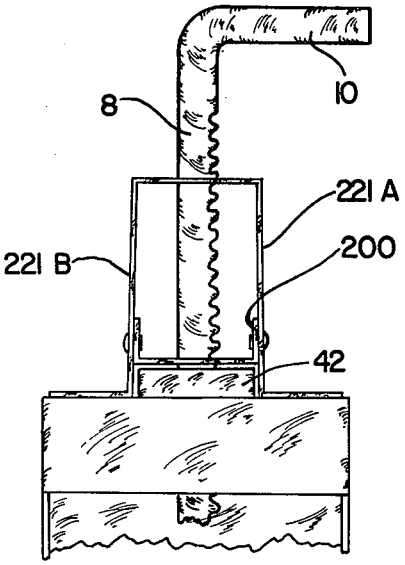
FIG. 3 is a top plan view of the release means of FIG. 1 employed in a ratchet type caulk gun.

While FIGS. 1 and 3 illustrate the use of the release device found in FIGS. 4 and 5 for a ratchet caulk gun, the versions shown in FIGS. 4 and 5 can be equally as well employed for a biased spring driven gun. The embodiments of the release device of FIGS. 4 and 5 will be discussed with more particularity below with respect to the biased spring type drive system as featured in Chang, U.S. Pat. No. 4,081,112 and as shown in FIGS. 6 and 7 thereof.

The thrust of the invention herein comprises the use of a stationary disposed elastic means that tightly encircles the piston rod 8. This pressure release device can be a ring 42 as illustrated in FIG. 4 having an annular exterior section 43 and a control bore 47 or as illustrated in FIG. 5 a deformable planar elongated member 42A having a bore 47 in a generally rounded edge rectangular planar member 43A.

Figure 6:
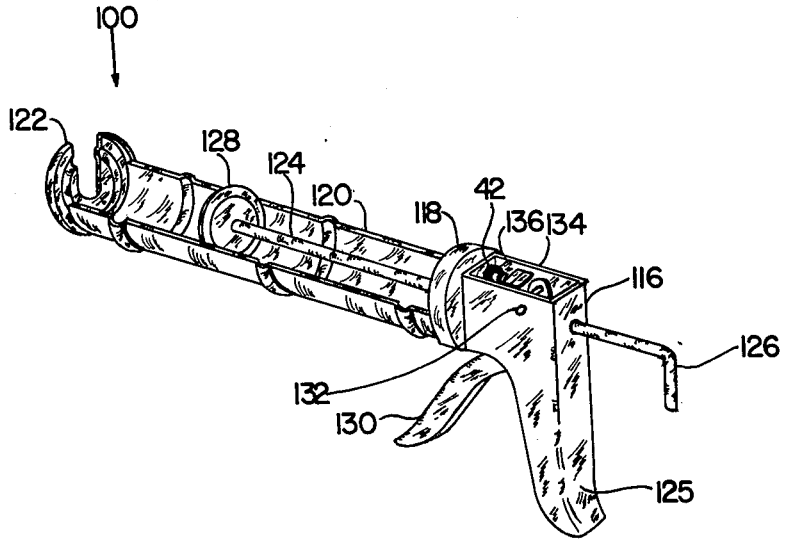
FIG. 6 is a perspective view of a biased grip driven caulk gun showing the release means of FIG. 5 mounted thereon.
Figure 7:
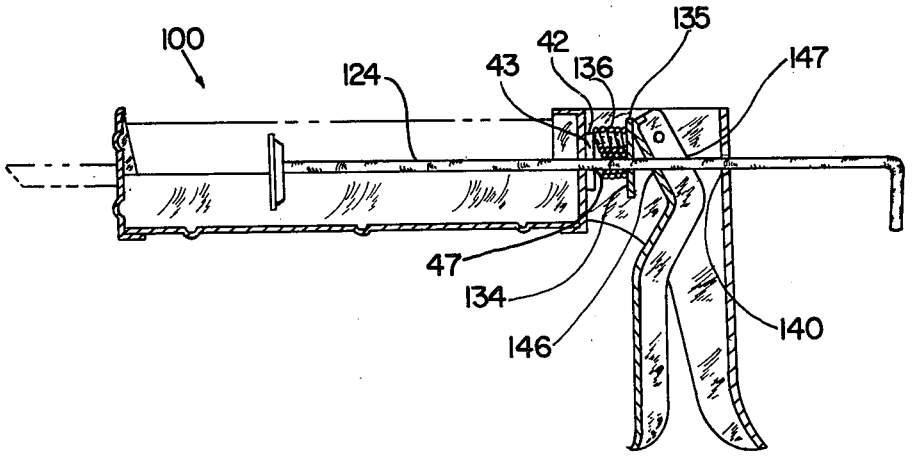
FIG. 7 is a side sectional view of the gun of FIG. 6 showing the release means of FIG. 5 under compression.

The pressure release device has a memory such that when the rod 8, as in FIG. 1 and 124 of FIG. 6, is driven, i.e., moves leftwardly, the walls 42 for instance, has it exterior section 43 compressed slightly inwardly due to the movement of said rod 8. When this movement ceases, i.e., upon return from trigger compression, the elastic memory of the rubber device, which is in a tightly encircling relationship with rod 8, causes the rod 8 to retract slightly as the exterior section 43 releases and returns to its original position. In a sense, the release device deforms upon rod movement, but such is not readily visible. Typically urethane and vinyl rubbers make suitable elastic release devices.

In the biased spring embodiment the spring 136 maintains the release device in its desired lateral location adjacent the intermediate wall. In the ratchet gun, where there is no spring, retainer 200 serves the same purpose of maintaining the disposition adjacent the intermediate wall 21.

It is important to understand the nature of the fit required of the pressure release device and piston rod 8 or 124 depending on embodiment. The fit must be loose enough to permit the urged movement of the rod forwardly but upon compression of the release device exterior section it must grab or clamp onto the rod sufficiently such that when the elastic memory force takes over it will retract the rod slightly as the exterior section returns to its normal position.

In retrospect it is seen that to force caulking compound from the caulk tube the operator squeezes the trigger 22 for pivotal rotation about pivot member 24 thereby rotating trigger 22 in a counterclockwise direction toward handle 20. FIG. 1 illustrates the position of trigger 22 at both the conclusion of its counterclockwise travel in full line and its original disposition prior to squeezing which is also the rest position at the completion of a stroke, in dotted line. The travel is shown by arrow TL. Details of the operation of both types of guns are now to be recited.

During the travel of trigger 22 in the ratchet run, the rachet pawl 32 engages the teeth 12 and is rotated together with the trigger in a counterclockwise direction to move rod 8 forwardly, i.e., longitudinally to the left, thereby forcing piston 14 against the bottom of the caulk tube. Since this rod driving is deemed conventional additional discussion is not necessary. Upon relaxation of the trigger, since pawl 32 has completed its travel it returns to its rest position per dotted line A, FIG. 1. It is substantially at termination of trigger travel inward that the deformation of the exterior body section of the release means terminates such that upon relaxation and return of the trigger the elastic memory causes the deformed section to move rightwardly or counter to the direction of the rod movement on its pressure application to slightly withdraw the rod.

Upon release of the trigger 22 it is spring biased to rotate in a clockwise direction which forces the ratchet pawl 32 to disengage from the ratchet teeth 12 and to likewise rotate in a clockwise direction past several teeth 12 on rod 8. The rod, due to its tight fit within caulk tube remains biased forwardly until the release means acts to withdraw it slightly as described above such that the memory urging the rod rightwardly is seen to overcome the biasing force leftwardly of the piston on rod 8, the flow of caulk is terminated.

Thus release of the trigger is translated into an automatic cessation of biasing force on the piston due to the automatic elastic memory force of the deformable release device, no matter which embodiment thereof is employed.

FIG. 6 is a perspective view of a spring biased grip drive caulk gun 100 whose piston rod 124 is free from ratchet teeth, prior to squeezing of trigger 130. FIG. 7 shows the trigger having traveled counterclockwise to a maximum point. As can be seen in the figures, trigger 130 is pivotally connected at pivot pin 132 which passes transversely through handle 116. As is seen in FIG. 7, a drive grip 134 is in operational contact with the trigger at the rear and with a spring 136 which itself is resiliently wedged between the forward wall of the housing and the drive grip above rod 124. An aperture 140 permits the rod 124 to pass through the rear wall 125, and apertures 146 and 147 permit travel of the rod through the handle 130.

The grip 134 surrounds the plunger shaft and said grip includes an upwardly extending portion 135 which is contacted by the tip of trigger 130. The grip clamps the rod shaft appropriately when contacted relative thereto urging it forwardly and releases it under urging or biasing of the spring 136. When spring 136 is fully compressed it both stops the trigger's counterclockwise movement and it then extends or relaxes to release the clamping and thus return the grip and trigger to their respective rest positions as seen in FIG. 6.

In conclusion it is seen that I have disclosed a pressure release means which is carried by the piston rod of the caulk gun between the rear and intermediate handle walls. This means comprises a deformable resillient device adapted to move from a rest position to a compressed position upon engagement with the piston rod, and being further adapted upon the cessation of forward biasing force upon release of the trigger of the gun to withdraw the rod from the direction of travel under biasing, upon relaxation of said device and return to a decompressed state.

Thus while the central bore is sized to permit travel of the rod therethrough, the fit is such that the rod engages the device and compresses and deforms same. The engaged rod is moved to a second position opposite the direction of initial travel when the release device decompresses.

Though not specifically shown in the drawings, the use of a deformable rubber grommet, similar to that employed in the parent case hereof, could be employed as the release device if it were properly mounted on the respective push rod 8 or 124. In light of the detailed previous description of this device in the parent case, a detailed explanation of same is not needed.

Since certain changes may be made in the above apparatus without departing from the scope of the invention herein, it is intended that all matter contained in the above description and shown in the accompanying drawings shall be interpreted as illustrative only, and not in a limiting sense.

What is claimed is:

1. In a caulking gun comprising:

(a) a housing for holding a caulking tube, said housing having a rear wall and an intermediate wall, (b) a piston rod having a piston at one end thereof for driving caulk compound from a tube of caulk, (c) a handle secured to said housing, (d) a trigger pivotally mounted to said handle for rotation about a pivot member, (e) a driving dog means cooperating with said trigger and said rod for forwardly driving said rod a finite distance each time the trigger is rotated in a counterclockwise direction, the improvement comprising:

(a) a deformable resilient pressure release means having a central bore therein, aligned with the path of travel of said rod and being adapted for engagement by said rod during forward travel, (b) said pressure release means being moveable from a first relaxed position to a compressed deformed position upon engagement of said rod therewith, (c) said release means also being adapted upon cessation of the forwardly driving of said rod, and clockwise rotation of said trigger to relax and return to the relaxed uncompressed position, (d) said rod being moveable to a position opposite its initial direction of travel upon decompression of said release means, (e) a spring carried by said rod, disposed behind said pressure release means, said deformable resilient pressure release means being disposed between the intermediate wall of said housing and the rear wall thereof and being compressed by the impingement of the spring therefrom upon trigger rotation, said pressure release means, and said spring cooperating to urge the driving dog means rearwardly to reset same into its at rest position and rendering it available for cooperation with said trigger by tensing the spring against said dog, said release means releasably gripping said rod and moving forwardly with said rod upon relaxation of said spring after reset of said dog means.

2. In the caulking gun of claim 1 wherein the pressure release means is a resilient circular bored rubber member.

3. In the caulk gun of claim 1 wherein the pressure release device is a rounded curved generally rectangular planar member having a bore therein.

4. In the caulk gun of claim 1 wherein the pressure release means is a resillient deformable rubber member having a bore therein, mounted on the drive rod and a retainer to maintain the rubber member in generally fixed disposition.

5. In the device of claim 1 wherein the housing is made of metal.

* * * * *